US009920661B2

(12) United States Patent
Kandolf et al.

(10) Patent No.: US 9,920,661 B2
(45) Date of Patent: Mar. 20, 2018

(54) CAMSHAFT PHASER WITH A ROTOR NOSE OIL FEED ADAPTER

(71) Applicant: Schaeffler Technologies GmbH & Co. KG, Herzogenaurach (DE)

(72) Inventors: Michael Kandolf, Saint Clair, MI (US); Matthias Kapp, Oak Park, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 157 days.

(21) Appl. No.: 14/273,178

(22) Filed: May 8, 2014

(65) Prior Publication Data

US 2014/0338618 A1 Nov. 20, 2014

Related U.S. Application Data

(60) Provisional application No. 61/824,033, filed on May 16, 2013.

(51) Int. Cl.
*F01L 1/344* (2006.01)

(52) U.S. Cl.
CPC ... *F01L 1/3442* (2013.01); *F01L 2001/34423* (2013.01); *F01L 2001/34483* (2013.01); *F01L 2103/00* (2013.01); *Y10T 29/49293* (2015.01)

(58) Field of Classification Search
CPC ... F01L 2001/34423; F01L 2001/34479; F01L 2001/34486; F01L 2001/34483; F01L 2001/3445; F01L 2001/3443; F01L 2001/34433; F01L 2001/34426; F01L 2001/34446; F01L 1/3442; F01L 2103/00; Y10T 137/8667; Y10T 29/49293
USPC ..... 123/90.15, 90.16, 90.17; 464/160
See application file for complete search history.

(56) References Cited

U.S. PATENT DOCUMENTS

| | | | | |
|---|---|---|---|---|
| 5,095,857 A * | 3/1992 | Hampton | F01L 1/34409 | 123/90.17 |
| 6,186,104 B1 | 2/2001 | Torii et al. | | |
| 6,295,964 B1 | 10/2001 | DiMaria et al. | | |
| 2007/0240657 A1* | 10/2007 | Schneider | F01L 1/34 | 123/90.18 |

(Continued)

FOREIGN PATENT DOCUMENTS

| | | |
|---|---|---|
| DE | 102009016186 | 10/2010 |
| DE | 102012200685 | 7/2013 |

*Primary Examiner* — Mark Laurenzi
*Assistant Examiner* — Paul Thiede
(74) *Attorney, Agent, or Firm* — Simpson & Simpson, PLLC

(57) ABSTRACT

A camshaft phaser, including: a drive sprocket; a phaser section including a rotor with a first radially aligned channels, first axially aligned channels connected to the first radially aligned channels, and chambers formed by the rotor and a stator; and a rotor nose separately formed from the phaser section and non-rotatably connected to the phaser section, extending past a front side of the phaser section in an axial direction, and including second radially aligned channels and second axially aligned channels connected to the second radially aligned channels and the first axially aligned channels. The second radially aligned channels are arranged to receive fluid for the plurality of chambers to phase the phaser. The first radially aligned channels and the first and second axially aligned channels form respective flow paths for the fluid from the second radially aligned channels to the plurality of chambers.

16 Claims, 8 Drawing Sheets

(56) References Cited

U.S. PATENT DOCUMENTS

| | | | | |
|---|---|---|---|---|
| 2009/0159025 | A1* | 6/2009 | Kimura | F01L 1/3442 123/90.15 |
| 2010/0186700 | A1* | 7/2010 | Kandolf | F01L 1/3442 123/90.17 |
| 2014/0190435 | A1* | 7/2014 | Wigsten | F01L 1/3442 123/90.17 |
| 2014/0224200 | A1* | 8/2014 | Luft | F01L 1/3442 123/90.17 |

* cited by examiner

CAMSHAFT PHASER WITH A ROTOR NOSE OIL FEED ADAPTER

CROSS-REFERENCE TO RELATED APPLICATIONS

This application claims the benefit under 35 U.S.C. § 119(e) of U.S. Provisional Application No. 61/824,033, filed May 16, 2013, which application is incorporated herein by reference in its entirety.

TECHNICAL FIELD

The present disclosure relates to a camshaft phaser with a modular rotor nose oil feed adapter configured to receive oil in radially aligned opening and flow oil in axially aligned channels to chambers for phasing the phaser. In particular, the rotor for the phaser includes axially aligned channels to receive the oil.

BACKGROUND

It is known to receive oil for chambers in a camshaft phaser, formed by a rotor and a stator for the phaser and used to control phasing of the phaser, in radially aligned channels opening to a radially central space. However, the requirement for a radially central space increases both the radial extent of the phaser and limits the spaces into which the phaser can be installed as well as the options for supplying oil to the chambers.

SUMMARY

According to aspects illustrated herein, there is provided a camshaft phaser, including: a drive sprocket arranged to receive torque; a phaser section including a stator non-rotatably connected to the drive sprocket, a rotor at least partially rotatable with respect to the stator and including a first plurality of radially aligned channels, a first plurality of axially aligned channels connected to the first plurality of radially aligned channels, and a plurality of chambers formed by the rotor and the stator and open to the first plurality of radially aligned channels; and a rotor nose separately formed from the phaser section and non-rotatably connected to the phaser section, extending past a front side of the phaser section in a first axial direction, and including a second plurality of radially aligned channels in a radially outer surface of the rotor nose assembly and a second plurality of axially aligned channels connected to the second plurality of radially aligned channels and in hydraulic communication with the first plurality of axially aligned channels. The plurality of chambers is arranged to circumferentially position, in response to fluid pressure in the plurality of chambers, the rotor with respect to the drive sprocket. The second plurality of radially aligned channels is arranged to receive fluid for the plurality of chambers. The first plurality of radially aligned channels and the first and second pluralities of axially aligned channels form respective flow paths for the fluid to the plurality of chambers.

According to aspects illustrated herein, there is provided a camshaft phaser, including: a drive sprocket arranged to receive torque; a phaser section; and a rotor nose. The phaser section includes: a stator non-rotatably connected to the drive sprocket; a rotor at least partially rotatable with respect to the stator and including a first plurality of radially aligned channels; a rotor plate non-rotatably connected to the rotor; a first plurality of axially aligned channels connected to the first plurality of radially aligned channels; and a plurality of chambers formed by the rotor and the stator and open to the first plurality of radially aligned channels. The rotor nose is separately formed from the phaser section and non-rotatably connected to the rotor plate; extends past a front side of the phaser section in a first axial direction; and includes second and third pluralities of radially aligned channels in a radially outer surface of the rotor nose assembly and a second plurality of axially aligned channels connected to the first plurality of axially aligned channels and to respective channels in the second and third pluralities of radially aligned channels. The plurality of chambers is arranged to circumferentially position, in response to fluid pressure in the plurality of chambers, the rotor with respect to the drive sprocket. The second and third pluralities of radially aligned channels are arranged to receive fluid for the plurality of chambers. The first plurality of radially aligned channels and the first and second pluralities of axially aligned channels form respective flow paths for the fluid to the plurality of chambers. The second plurality of radially aligned channels is axially offset with respect to the third plurality of radially aligned channels.

According to aspects illustrated herein, there is provided a method of fabricating a camshaft phaser, including: fixedly securing a stator to a drive sprocket arranged to receive torque; inserting a rotor within a space formed by the stator such that the rotor is at least partially rotatable with respect to the stator, wherein the rotor includes a first plurality of radially aligned channels and a first plurality of axially aligned channels; forming a plurality of chambers bounded by the stator and the rotor; fixedly connecting a rotor plate to the rotor, wherein the rotor plate includes a second plurality of axially aligned channels; fixedly connecting a rotor nose to the rotor plate such that the rotor nose extends axially past the rotor and the rotor plate, wherein the rotor nose includes a third plurality of axially aligned channels and a second plurality of radially aligned channels; and hydraulically connecting the first and second radially aligned channels via the first, second, and third pluralities of axially aligned channels. The plurality of chambers is arranged to circumferentially position, in response to fluid pressure in the plurality of chambers, the rotor with respect to the drive sprocket. The second plurality of radially aligned channels is arranged to receive fluid for the plurality of chambers.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1A:
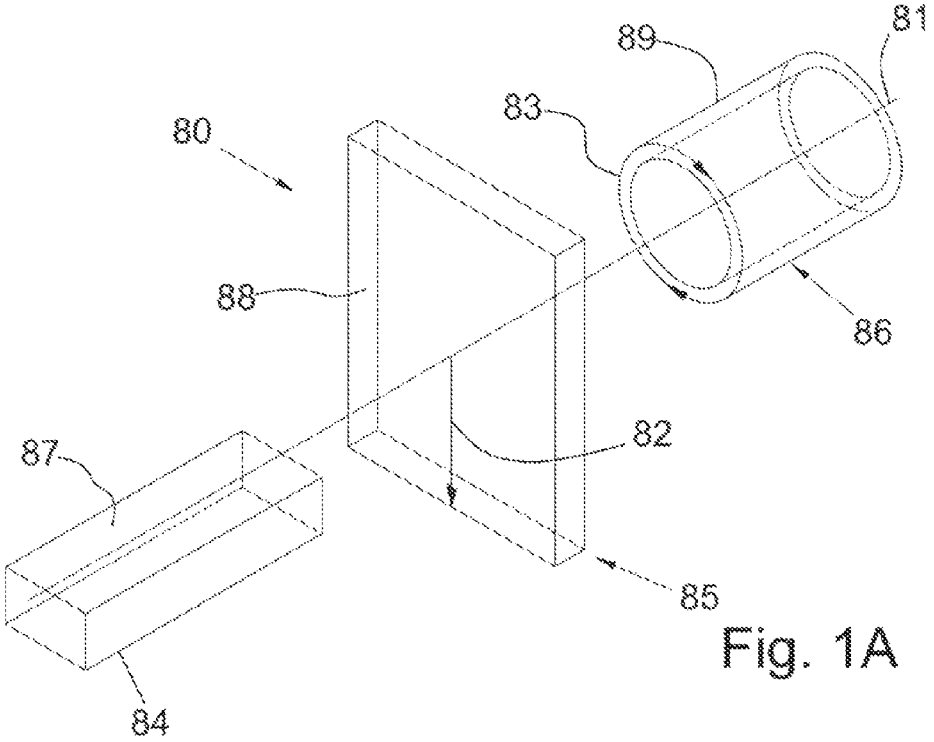
FIG. 1A is a perspective view of a cylindrical coordinate system demonstrating spatial terminology used in the present application.

FIG. 1A is a perspective view of cylindrical coordinate system 80 demonstrating spatial terminology used in the present application. The present disclosure is at least partially described within the context of a cylindrical coordinate system. System 80 has a longitudinal axis 81, used as the reference for the directional and spatial terms that follow. The adjectives "axial," "radial," and "circumferential" are with respect to an orientation parallel to axis 81, radius 82 (which is orthogonal to axis 81), and circumference 83, respectively. The adjectives "axial," "radial" and "circumferential" also are regarding orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential plane. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" are with respect to an orientation parallel to axis 81, radius 82, or circumference 83, respectively. The adverbs "axially," "radially," and "circumferentially" also are regarding orientation parallel to respective planes.

Figure 1B:
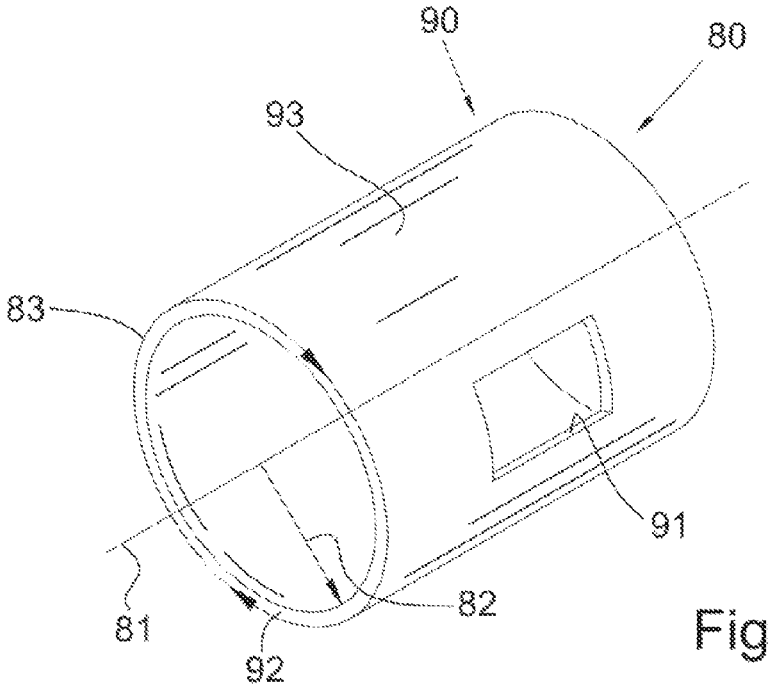
FIG. 1B is a perspective view of an object in the cylindrical coordinate system of FIG. 1A demonstrating spatial terminology used in the present application.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present invention in any manner. Object 90 includes axial surface 91, radial surface 92, and circumferential surface 93. Surface 91 is part of an axial plane, surface 92 is part of a radial plane, and surface 93 is a circumferential surface.

Figure 2:
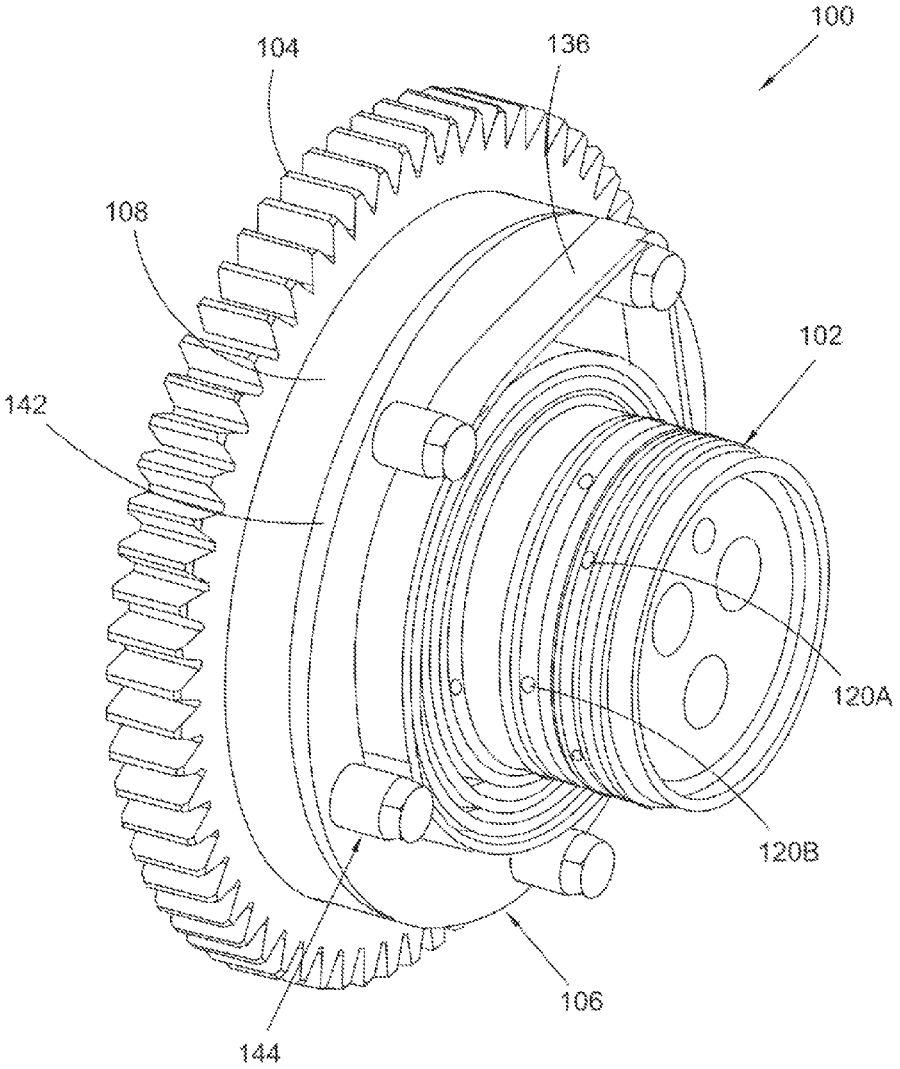
FIG. 2 is a front perspective view of a camshaft phaser with a rotor nose oil feed adapter.

FIG. 2 is a front perspective view of camshaft phaser 100 with rotor nose oil feed adapter 102.

Figure 3:
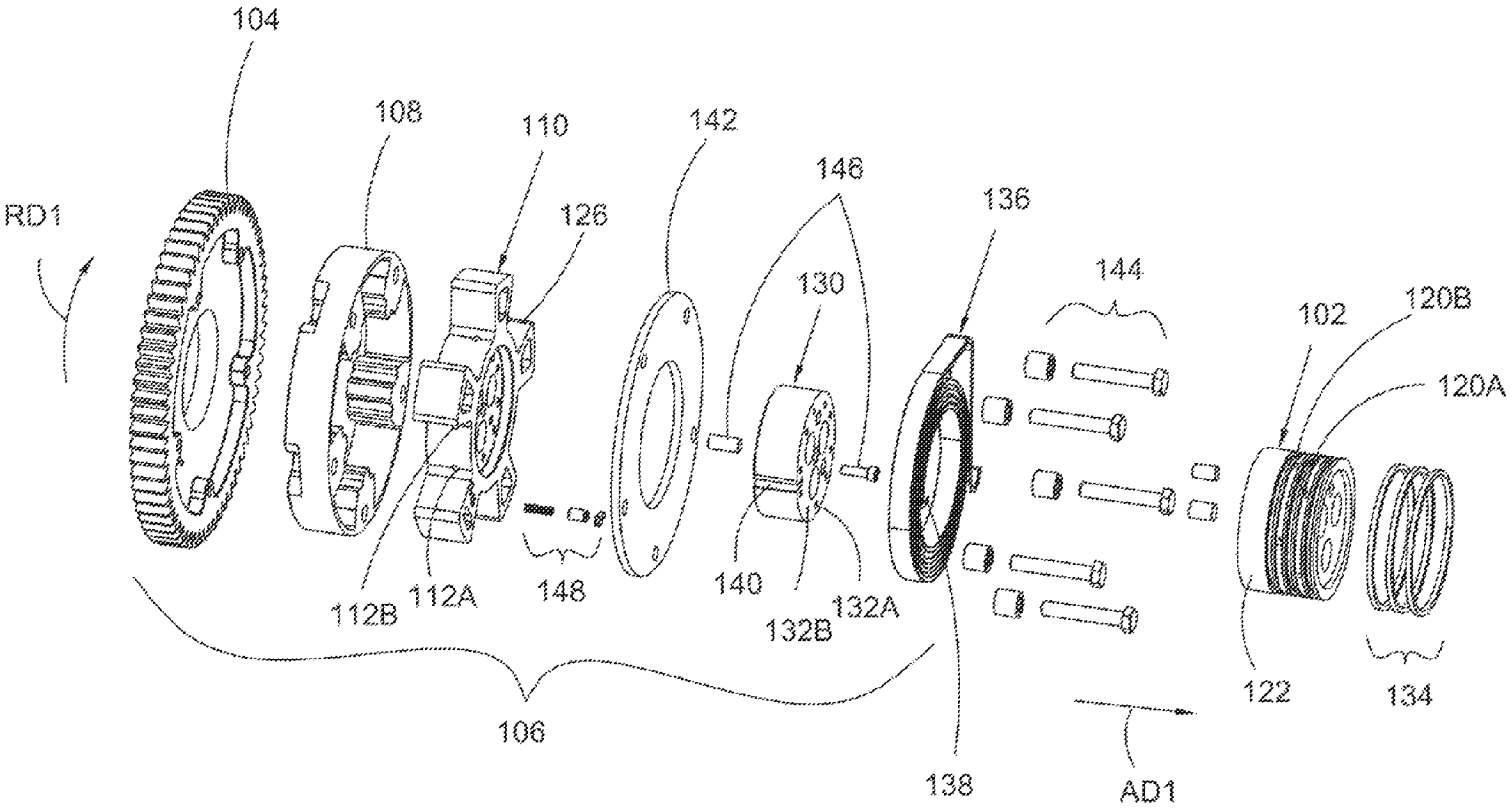
FIG. 3 is an exploded view of the camshaft phaser in FIG. 2.

FIG. 3 is an exploded view of camshaft phaser 100 in FIG. 2.

Figure 4:
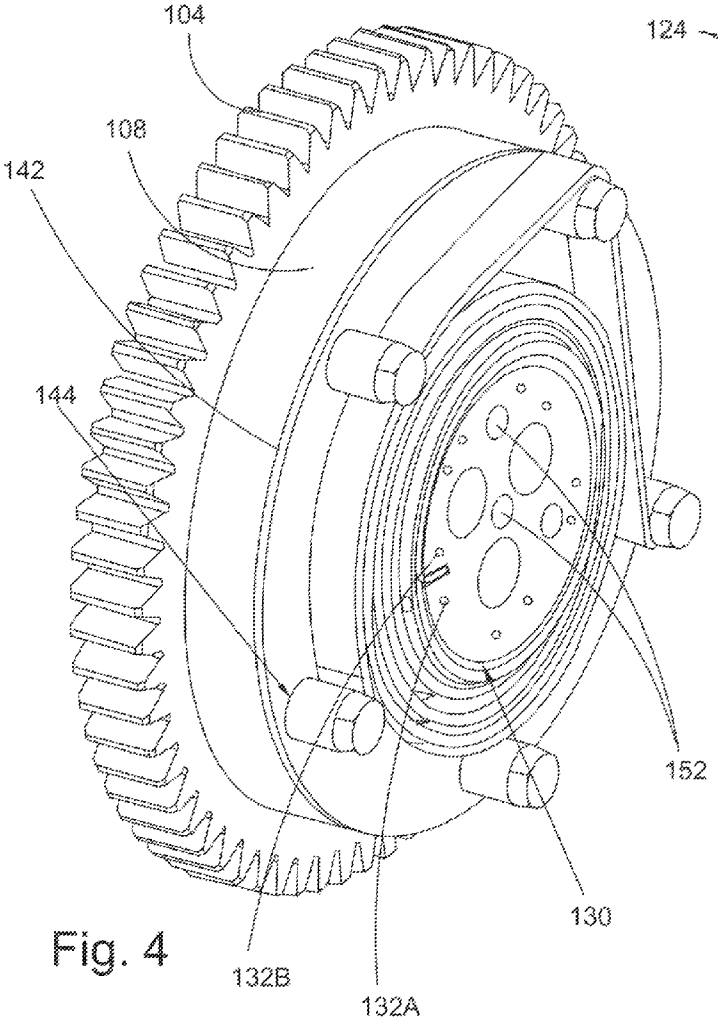
FIG. 4 is a front perspective view of the phaser section in FIG. 2.

FIG. 4 is a front perspective view of the phaser section in FIG. 2.

Figure 5:
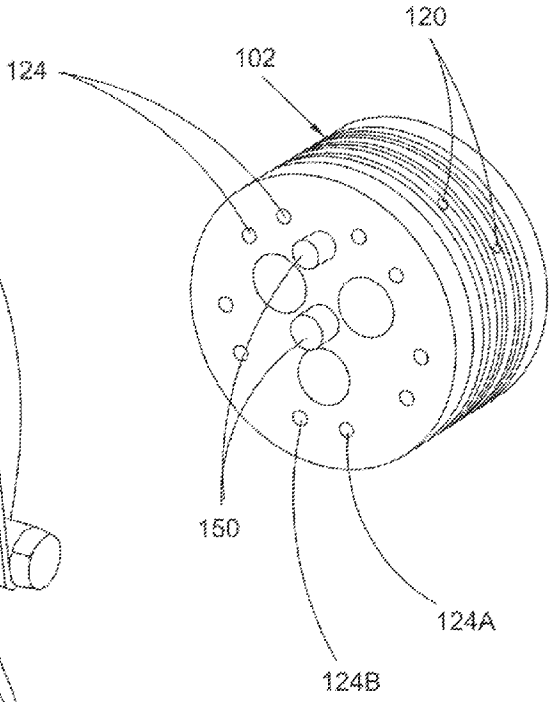
FIG. 5 is a back perspective view of the rotor nose oil feed adapter in FIG. 2.

FIG. 5 is a back perspective view of rotor nose oil feed adapter 102 in FIG. 2.

Figure 6:
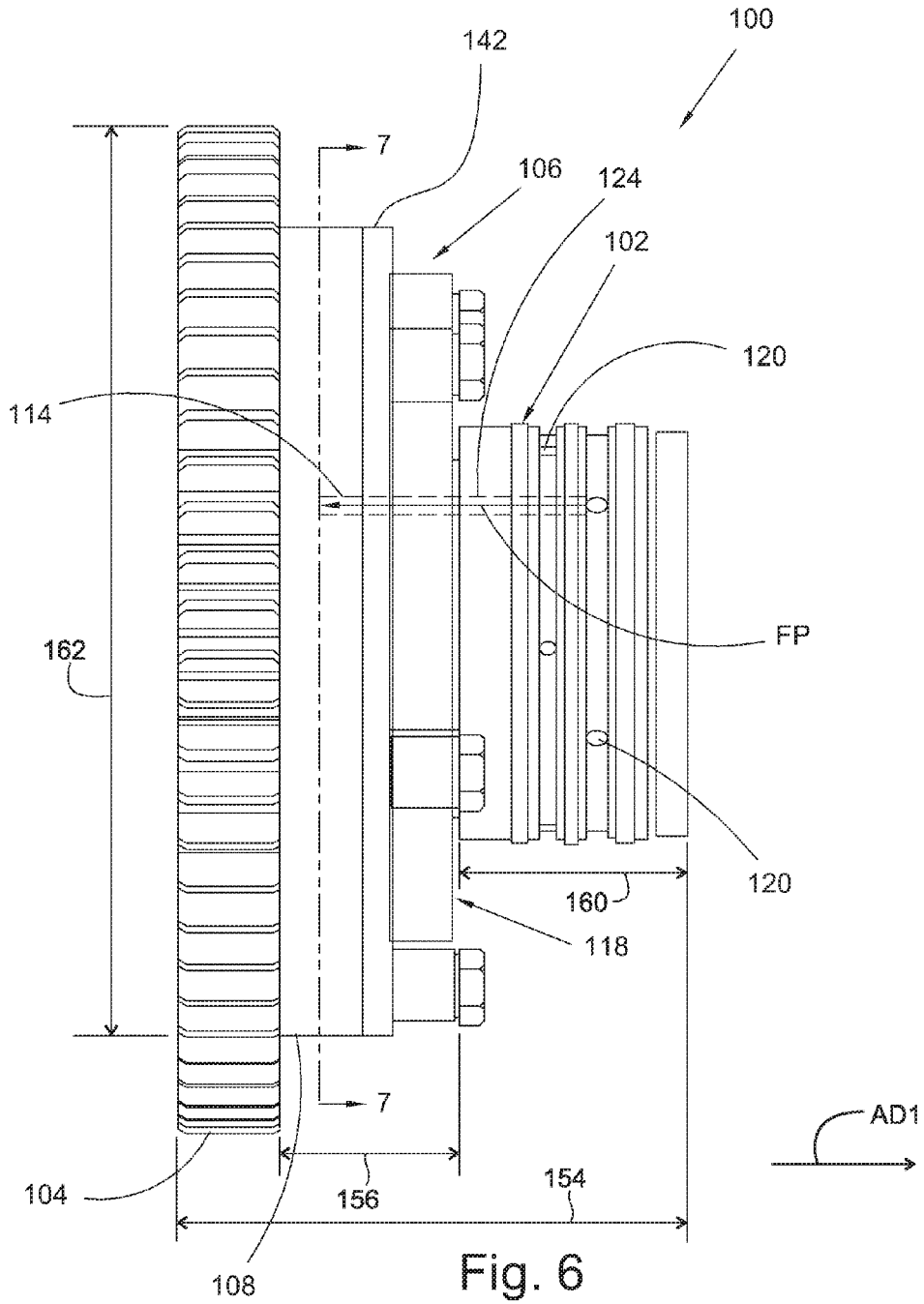
FIG. 6 is a side view of the camshaft phaser in FIG. 2.
Figure 7:
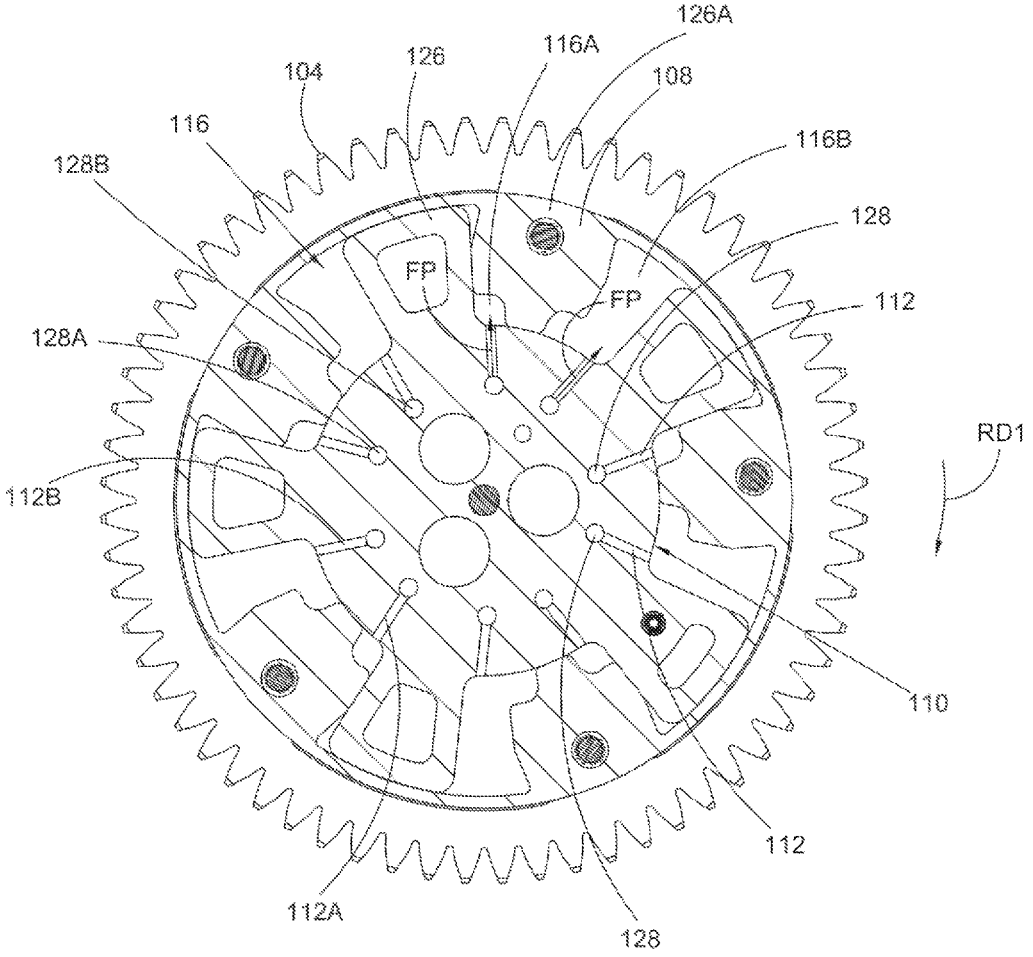
FIG. 7 is a cross-sectional view generally along line 7-7 in FIG. 6.

FIG. 6 is a side view of camshaft phaser 100 in FIG. 2; and,

FIG. 7 is a cross-sectional view generally along line 7-7 in FIG. 6. The following should be viewed in light of FIGS. 2 through 7. Phaser 100 includes drive sprocket 104 arranged to receive torque and phaser section 106. Section 106 includes: stator 108 non-rotatably connected to the drive sprocket; rotor 110 at least partially rotatable with respect to the stator and having radially aligned channels 112; axially aligned channels 114 (only one of which is shown in FIG. 6) connected to radially aligned channels 112; and chambers 116 formed by the rotor and the stator, and open to (fed by) radially aligned channels 112. Rotor nose 102 is separately formed from portion 106, non-rotatably connected to section 106, and extends past front side 118 of section 106 in axial direction AD1. Radially aligned channels 112 and axially aligned channels 114 form respective flow paths FP for the fluid to chambers 116.

Rotor nose 102 includes radially aligned channels 120 in radially outer surface 122 of the rotor nose, and axially aligned channels 124 connected to radially aligned channels 120 and in hydraulic communication with axially aligned channels 114. Channels 120 and 124 form respective portions or flow paths FP. By "hydraulic communication" we mean that fluid is able to flow between the two sets of channels. Chambers 116 are arranged to circumferentially position, in response to fluid pressure in chambers 116, the rotor with respect to the drive sprocket. Radially aligned channels 120 are arranged to receive fluid for flow paths FP and chambers 116.

Rotor 110 includes vanes 126. In an example embodiment, radial channels 112 include pairs of channels 112A and 112B and axial channels 114 includes pairs of channels 128A and 128B in the rotor connected to channels 112A and 112B, respectively. Each vane forms a portion of a respective pair of chambers 116, for example, vane 126A forms chambers 116A and 116B in conjunction with the stator. Channels 112A and 112B open to chambers 116A and 116B, respectively.

In an example embodiment, section 106 includes rotor plate 130 non-rotatably connected to the rotor and pairs of axially aligned channels 132A and 132B in hydraulic communication with axially aligned channels 128A and 128B, respectively. Channels 132A and 132B are included in channels 114 and flow paths FP.

In an example embodiment, radial channels 120 include pairs of channels 120A and 120B and axial channels 124 includes channels 124A and 124B connected to channels 120A and 120B, respectively. In an example embodiment, channels 120A are axially off-set from channels 120B, for example, in axial direction AD1. In an example embodiment, seals 134 are used to hydraulically isolate channels 120A and 120B.

In an example embodiment, spring 136 is used to provide a default positioning force for rotor 110 as is known in the art. For example, tab 138 is engaged with slot 140 in plate 130. Spring 136 is preloaded such that tab 138 urges plate 130 (and hence rotor 110 which is non-rotatably connected to plate 130) in rotational direction RD1. As a result, rotor 110 is positioned as best seen in FIG. 7.

In an example embodiment, seal plate 142 is used to seal chambers 116. In an example embodiment, bolt/bushing assembly 144 is used to non-rotatably connect plate 142, stator 108 and sprocket 104. Bolts 144 also are used to anchor spring 136. In an example embodiment, fastener/bushing 146 is used to non-rotatably connect plate 130 and rotor 110. In an example embodiment, locking pin assembly 148 is used to lock rotor 110 in a default position as is known in the art. In an example embodiment, alignment pegs 150 on rotor nose are arranged to engage alignment holes 152 in plate 130 to align rotor nose 102 with plate 130 and to non-rotatably fix rotor nose 102 to plate 130.

Figure 8:
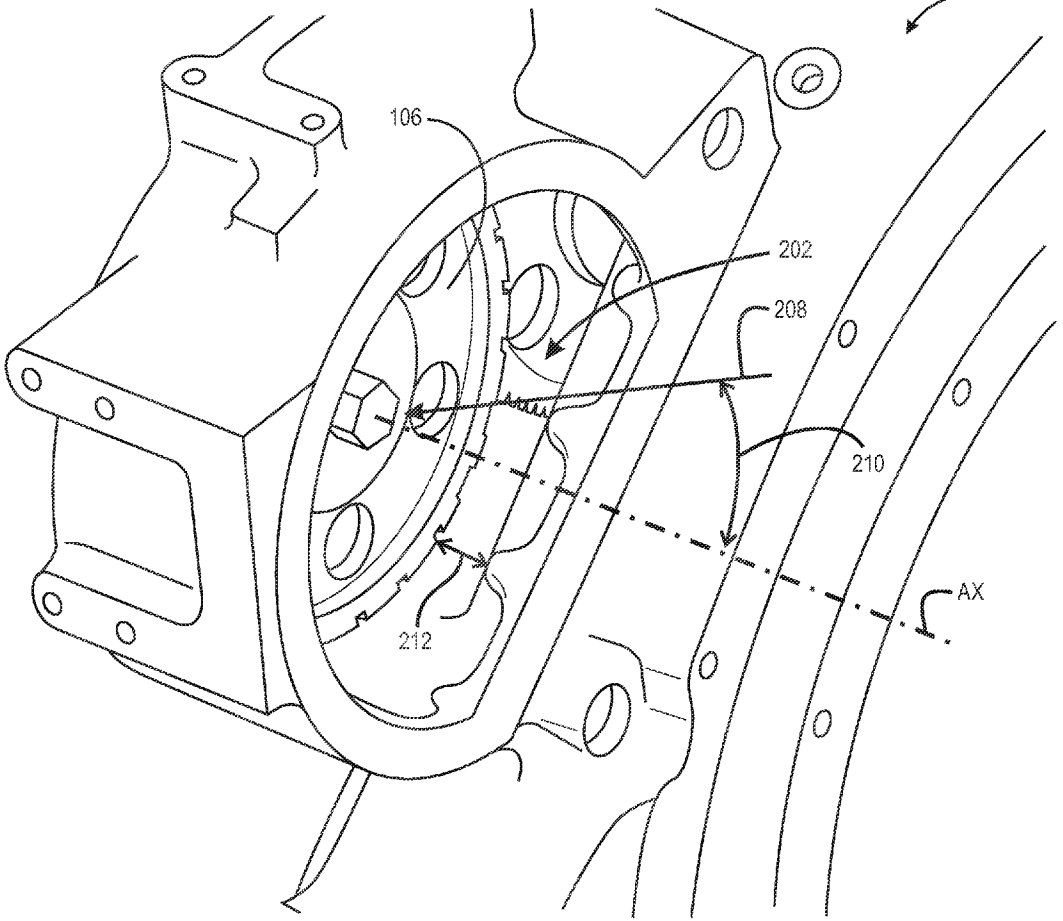
FIG. 8 is a partial perspective view of the camshaft phaser in FIG. 2, without the rotor nose, installed in an engine; and, FIG. 9 is a partial front view showing the camshaft phaser in FIG. 8.

FIG. 8 is a partial perspective view of camshaft phaser 100 in FIG. 2, without the rotor nose, installed in an engine.

Figure 9:
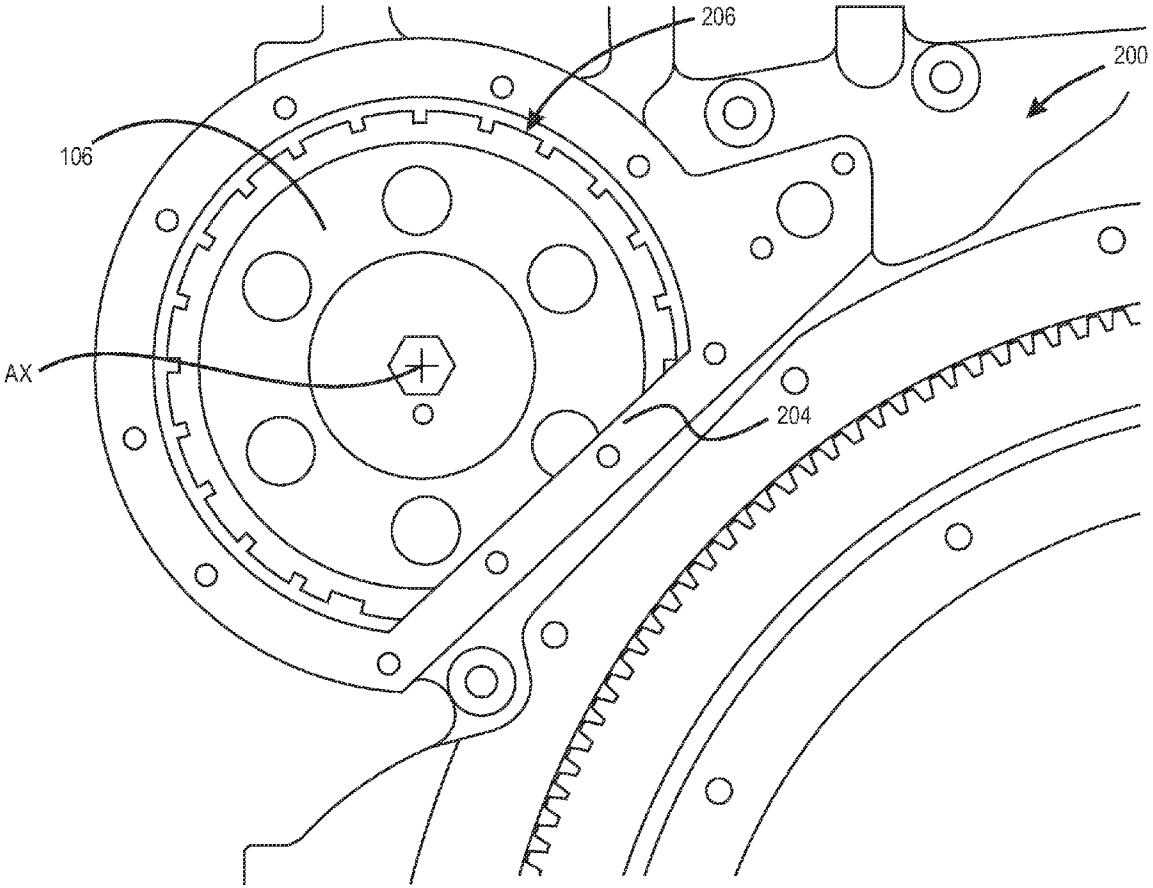

FIG. 9 is a partial front view showing camshaft phaser 100 in FIG. 8. Rotor nose 102 and the configuration of section 106 advantageously solve the problem noted above of limited axial and radial space for installing a camshaft phaser. For example, for engine 200, phaser 100 must be installed in space 202. However, portion 204 of circumference 206 of the opening for the space blocks the insertion of the phaser into space 202 in a direction parallel to axis AX of the phaser (the axis of rotation for the phaser once the phaser is installed in the engine). That is, the phaser must be tipped for insertion past circumference 206, for example, in direction 208 at angle 210 with respect to axis AX. However, length 154 (see FIG. 6) of phaser 100 is too great to enable the phaser to be tipped and inserted through the opening. Advantageously, however, rotor nose 102 can be separated from section 106 and length 156 (see FIG. 6) of phaser section 106 is small enough to enable phaser section 106 to be tipped and inserted as shown in FIGS. 8 and 9. When section 106 is installed in the engine, section 106 is separated from portion 204 by distance 212. Advantageously, length 160 of rotor nose 102 (see FIG. 6) is such that the rotor nose can be inserted into space 202 and attached to section 106 after section 106 is installed. Due to the use of pegs 150 and openings 152, it is not necessary to provide access, which would be blocked by portion 204, to fasteners for rotor nose 102.

The size of the opening for space 202 and the dimensions of space 202 itself also limit an extent of diameter 162 for phaser 100. Advantageously, channels 112 and 114 eliminate the need for a radial feed to chambers 116 from a radially central space. Hence, the radially central space is eliminated with a subsequent reduction in diameter 162. All of the preceding factors enable phaser 100 to be used in applications with space and access restrictions that eliminate the use of known camshaft phaser configurations.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A camshaft phaser, comprising:

a drive sprocket arranged to receive torque;

a phaser section including:

a stator non-rotatably connected to the drive sprocket;

a rotor at least partially rotatable with respect to the stator and including a first plurality of radially aligned channels;

a first plurality of axially aligned channels connected to the first plurality of radially aligned channels; and, a plurality of chambers formed by the rotor and the stator and open to the first plurality of radially aligned channels; and, a rotor nose:

separately formed from the phaser section and non-rotatably connected to the phaser section;

extending from and past a front side of the phaser section in a first axial direction, in which the drive sprocket has a spaced relationship from the front side of the phaser section in a second axial direction opposite to the first axial direction; and, including:

a second plurality of radially aligned channels in a radially outer surface of the rotor nose; and, a second plurality of axially aligned channels connected to the second plurality of radially aligned channels and in hydraulic communication with the first plurality of axially aligned channels, wherein:

the plurality of chambers is arranged to circumferentially position, in response to fluid pressure in the plurality of chambers, the rotor with respect to the drive sprocket;

the second plurality of radially aligned channels is arranged to receive fluid for the plurality of chambers; and, the first plurality of radially aligned channels and the first plurality of axially aligned channels and the second plurality of axially aligned channels form respective flow paths to the plurality of chambers; and, a plurality of seals, wherein the plurality of seals are arranged to hydraulically isolate said second plurality of radially aligned channels.

2. The camshaft phaser of claim 1, wherein:

the rotor includes:

a plurality of vanes;

third and fourth pluralities of radially aligned channels; and, third and fourth pluralities of axially aligned channels, connected to the third and fourth pluralities of radially aligned channels, respectively;

each vane of the plurality of vanes forms a portion of a respective pair of first and second chambers from the plurality of chambers;

the third and fourth pluralities of radially aligned channels open to the first and second chambers, respectively;

the first plurality of radially aligned channels includes the third and fourth pluralities of radially aligned channels; and, the first plurality of axially aligned channels includes the third and fourth pluralities of axially aligned channels.

3. The camshaft phaser of claim 2, wherein:

the phaser section includes a rotor plate non-rotatably connected to the rotor and including fifth and sixth pluralities of axially aligned channels in hydraulic communication with the third and fourth pluralities of axially aligned channels, respectively;

the first plurality of axially aligned channels includes the fifth and sixth pluralities of axially aligned channels.

4. The camshaft phaser of claim 3, wherein:

the second plurality of axially aligned channels includes seventh and eighth pluralities of axially aligned channels in hydraulic communication with the fifth and sixth pluralities of axially aligned channels, respectively; and, the second plurality of radially aligned channels includes fifth and sixth pluralities of radially aligned channels connected to the seventh and eighth pluralities of axially aligned channels, respectively.

5. The camshaft phaser of claim 4, wherein:

the fifth plurality of radially aligned channels is axially off-set from the sixth plurality of radially aligned channels.

6. The camshaft phaser of claim 2, wherein:

the second plurality of axially aligned channels includes fifth and sixth pluralities of axially aligned channels; and, the second plurality of radially aligned channels includes fifth and sixth pluralities of radially aligned channels, the fifth and sixth pluralities of radially aligned channels connected to the fifth and sixth pluralities of axially aligned channels, respectively.

7. The camshaft phaser of claim 6, wherein:

the fifth plurality of radially aligned channels is axially off-set from the sixth plurality of radially aligned channels.

8. A camshaft phaser, comprising:

a drive sprocket arranged to receive torque;

a phaser section including:

a stator non-rotatably connected to the drive sprocket;

a rotor at least partially rotatable with respect to the stator and including a first plurality of radially aligned channels;

a rotor plate non-rotatably connected to the rotor;

a first plurality of axially aligned channels connected to the first plurality of radially aligned channels; and, a plurality of chambers formed by the rotor and the stator and open to the first plurality of radially aligned channels; and, a rotor nose:

separately formed from the phaser section and non-rotatably connected to the rotor plate;

extending past a front side of the phaser section in a first axial direction; and, including:

second and third pluralities of radially aligned channels in a radially outer surface of the rotor nose; and, a second plurality of axially aligned channels connected to the first plurality of axially aligned channels and to respective channels in the second plurality of radially aligned channels and the third plurality of radially aligned channels, wherein:

the plurality of chambers is arranged to circumferentially position, in response to fluid pressure in the plurality of chambers, the rotor with respect to the drive sprocket;

the second plurality of radially aligned channels and the third plurality of radially aligned channels are arranged to receive fluid for the plurality of chambers;

the first plurality of radially aligned channels and the first and second pluralities of axially aligned channels form respective flow paths to the plurality of chambers; and, the second plurality of radially aligned channels is axially offset with respect to the third plurality of radially aligned channels; and, a plurality of seals, wherein the plurality of seals are arranged to hydraulically isolate said second plurality of radially aligned channels.

9. The camshaft phaser of claim 8, wherein:

the second plurality of axially aligned channels includes third and fourth pluralities of axially aligned channels connected to the second and third pluralities of radially aligned channels, respectively.

10. The camshaft phaser of claim 9, wherein:

the first plurality of radially aligned channels includes fourth and fifth pluralities of radially aligned channels; and, the rotor plate includes fifth and sixth pluralities of axially aligned channels connected to the third and fourth pluralities of axially aligned channels, respectively, and to the fourth and fifth pluralities of radially aligned channels, respectively.

11. The camshaft phaser of claim 10, wherein:

the rotor includes a plurality of vanes;

each vane of said plurality of vanes forms a portion of a respective pair of first and second chambers from the plurality of chambers; and, the fourth and fifth pluralities of radially aligned channels open to the first and second chambers, respectively.

12. A method of fabricating a camshaft phaser, comprising:

fixedly securing a stator to a drive sprocket arranged to receive torque;

inserting a rotor within a space formed by the stator such that the rotor is at least partially rotatable with respect to the stator, wherein the rotor includes a first plurality of radially aligned channels and a first plurality of axially aligned channels;

forming a plurality of chambers bounded by the stator and the rotor;

fixedly connecting a rotor plate to the rotor, wherein the rotor plate includes a second plurality of axially aligned channels;

connecting a spring to the rotor plate, wherein the spring urges the rotor plate in a first rotational direction;

installing the drive sprocket, assembled with the rotor and rotor plate, in an engine;

fixedly connecting a rotor nose to the rotor plate such that the rotor nose extends axially past the rotor and the rotor plate, wherein the rotor nose includes a third plurality of axially aligned channels and a second plurality of radially aligned channels; and, hydraulically connecting the first and second radially aligned channels via the first, second, and third pluralities of axially aligned channels, wherein:

the plurality of chambers is arranged to circumferentially position, in response to fluid pressure in the plurality of chambers, the rotor with respect to the drive sprocket; and, the second plurality of radially aligned channels is arranged to receive fluid for the plurality of chambers.

13. The method of claim 12, wherein:

forming a plurality of chambers includes forming a plurality of pairs of respective first and second chambers, each pair of chambers partially formed by a respective vane of the rotor;

the first plurality of radially aligned channels includes third and fourth pluralities of radially aligned channels opening to the respective first and second chambers, respectively;

the first plurality of axially aligned channels includes fourth and fifth pluralities of axially aligned channels connected to the third and fourth pluralities of radially aligned channels, respectively.

14. The method of claim 13, wherein:

the second plurality of axially aligned channels includes sixth and seventh pluralities of axially aligned channels hydraulically connected to the fourth and fifth pluralities of axially aligned channels, respectively.

15. The method of claim 14, wherein:

the third plurality of axially channels includes eighth and ninth pluralities of axially aligned channels in hydraulic communication with the sixth and seventh pluralities of axially aligned channels, respectively; and, the second plurality of radially aligned channels includes fifth and sixth pluralities of radially aligned channels connected to the eighth and ninth pluralities of axially aligned channels, respectively.

16. The method of claim 15, wherein: the fifth plurality of radially aligned channels is axially off-set from the sixth plurality of radially aligned channels.

* * * * *